US006637714B1

(12) United States Patent
Hall

(10) Patent No.: US 6,637,714 B1
(45) Date of Patent: Oct. 28, 2003

(54) APPARATUS FOR SUPPORTING READING MATERIAL

(76) Inventor: Leslie Margaret Hall, 801 W. Alabama Ave., Bessemer City, NC (US) 28016

( * ) Notice: Subject to any disclaimer, the term of this patent is extended or adjusted under 35 U.S.C. 154(b) by 0 days.

(21) Appl. No.: 10/164,215

(22) Filed: Jun. 6, 2002

(51) Int. Cl.[7] ..... A47B 5/04
(52) U.S. Cl. ..... 248/444.1; 248/454
(58) Field of Search ..... 248/444.1, 445, 248/448, 449, 454, 455; 108/6, 23, 49, 1, 12

(56) References Cited

U.S. PATENT DOCUMENTS

| | | | | | |
|---|---|---|---|---|---|
| 1,083,764 | A | | 1/1914 | Smith | |
| 1,916,667 | A | | 7/1933 | Hoogendyk | |
| 2,211,480 | A | | 8/1940 | Ring | |
| 2,546,283 | A | | 3/1951 | Webster | |
| 2,823,489 | A | | 2/1958 | Laing | |
| 2,828,577 | A | * | 4/1958 | Anderson | 248/445 |
| 2,896,364 | A | | 7/1959 | McCollister | |
| 3,135,513 | A | * | 6/1964 | Simpson | 248/444.1 |
| 3,476,348 | A | | 11/1969 | Rustad | |
| 3,664,629 | A | | 5/1972 | Reed | |
| 3,740,015 | A | | 6/1973 | Adams | |
| 3,790,770 | A | | 2/1974 | Stern | |
| 4,017,920 | A | * | 4/1977 | Sieg | 5/507.1 |
| 4,313,589 | A | | 2/1982 | Vega | |
| 4,431,156 | A | | 2/1984 | Mena | |
| 4,465,255 | A | | 8/1984 | Hill | |
| 4,685,647 | A | | 8/1987 | Calhoun | |
| 4,718,630 | A | | 1/1988 | Richard | |
| 4,867,407 | A | * | 9/1989 | Becker | 248/444.1 |
| 5,129,616 | A | | 7/1992 | Carson | |
| 5,259,581 | A | | 11/1993 | Goldberg | |
| 5,351,927 | A | | 10/1994 | Howell | |
| 5,485,980 | A | | 1/1996 | Luccia | |
| 5,624,096 | A | * | 4/1997 | Haynes | 248/451 |
| 5,884,889 | A | * | 3/1999 | Crosby | 248/460 |
| 5,913,502 | A | | 6/1999 | Smith | |
| 6,298,507 | B1 | * | 10/2001 | Clyburn | 5/623 |

* cited by examiner

*Primary Examiner*—Leslie A. Braun
*Assistant Examiner*—A. Joseph Wujciak
(74) *Attorney, Agent, or Firm*—Summa & Allan, P.A.

(57) ABSTRACT

A support apparatus for suspending reading material above an individual lying in a substantially horizontal position comprises in one embodiment a transparent platform, a pair of spaced apart support members that are secured to the platform, and at least one flexible suspension device. Upon assembly, the support apparatus permits the individual lying beneath the transparent platform to view reading material that is supported by the platform.

36 Claims, 2 Drawing Sheets

APPARATUS FOR SUPPORTING READING MATERIAL

FIELD OF THE INVENTION

The invention relates to a support apparatus for suspending reading material above an individual lying in a substantially horizontal or inclined position. In particular, the invention relates to an adjustable support apparatus that attaches to a variety of fixtures to provide support for reading material.

BACKGROUND OF THE INVENTION

Reading in bed is a popular pastime for many people. Unfortunately, reading in bed or while reclining tends to aggravate neck, back, and shoulder pain. This pain results from the awkward positioning of the body when reading in bed without the assistance of a tray or shelf.

Specifically, an individual reading in bed is required to flex neck muscles to maintain the head in a substantially vertical position and shoulder muscles to hold the book upright.

Several existing devices for reading in bed include trays, shelves, and mobile carts. These devices include trays supported by the lap, trays attached to portable frameworks adjacent the bed, and over-sized pillows (commonly referred to as "husbands"). Unfortunately, known devices incorporate a plurality of moving parts (e.g., screws, sliding brackets, and pivotable links) that are susceptible to failure. Thus, there is a need for an apparatus for supporting reading material that promotes reliability and ease of use.

As disclosed, existing devices are oftentimes limited to use in bed and require permanent attachment to customized brackets secured to a substantially planar surface such as a wall or headboard. These devices do not adequately meet the needs of the general public that may desire to read while, for example, lying on a floor or under a tree. Accordingly there is also a need for apparatus for supporting reading material that can be readily attached to a variety of fixtures having non-planar surfaces.

Furthermore several existing devices that include non-adjustable support surfaces (i.e., fixed inclination) prevent an individual from lying flat and reading in bed. Thus there is a need for an apparatus for supporting reading material that permits a user to adjust the inclination of the surface supporting the reading material to a desired position.

Other known devices that rely upon mobile frameworks (e.g., base support having wheels) block access to the bed and can pose safety risks.

Of these known devices, U.S. Pat. No. 4,313,689 to Vega describes a permanently inclined desk that supports reading material. More specifically, Vega discloses a non-adjustable inclined desk having a transparent plate that is supported by legs. The legs include a lower part that extends substantially parallel to the surface upon which the desk rests. Nevertheless, Vega fails to provide an adjustable surface for supporting reading material. In other words, the desk is fixed at a particular angle. Further, Vega fails to provide an apparatus that can be used on an irregular surface (e.g., ground or sloped furniture). Stated differently, the legs of Vega limit use to a substantially flat surface. Thus, there is a need for an apparatus that can be used on irregular surfaces. Further, the square shape of the desk described in Vega fails to provide ready access to the reading material. Accordingly, an individual using the Vega apparatus cannot readily turn pages of the reading material without straining to reach the material. Thus, there is also a need for a support apparatus that provides ready access to the reading material for the turning of pages and repositioning the material. Accordingly, the permanent incline of the desk, the requirement for a substantially horizontal support, and the lack of access to the reading material renders the Vega apparatus impractical for use by, for example, an individual reclining on an uneven surface.

In comparison, the adjustability of the present invention coupled with the shape of its support members permits an individual to use the invention on a variety of surfaces. Simply stated, the present invention is easier to construct and maintain.

U.S. Pat. No. 5,913,502 to Smith describes a document holder that permits a user to read while in bed. Specifically, the document holder includes a base, a flexible member secured at one end to the base and secured at another end to a plate, wherein the plate is secured to a wall bracket. Nevertheless, the flexible member of Smith is not suitable for supporting reading material heavier than, for example, a paperback book. Further, the flexible member and support plate of Smith must be permanently fixed to a wall or other substantially planar body.

In contrast, the present invention is capable of supporting hardback books and is not limited to newspapers magazines, and paperback books. Moreover, the present invention does not require permanent attachment to a substantially planar body.

SUMMARY OF THE INVENTION

It is therefore an object of the present invention to provide an apparatus for supporting reading material that is reliable and easy to use.

A further object of the invention is the provision of an apparatus for supporting reading material that can be readily attached to a variety of fixtures.

Yet another object of the invention is the provision of an apparatus for supporting reading material that permits the user to adjust the inclination of the surface supporting the reading material.

Another object of the invention is the provision of an apparatus for supporting reading material that can be used on irregular surfaces.

Still another object of the invention is the provision of an apparatus that facilitates access to the reading material.

The invention meets these objectives with a support apparatus for suspending reading material above an individual lying in a horizontal or inclined position that supports oversized books, provides an adjustable support surface to accommodate various positions of the user, permits use on uneven surfaces, and readily attaches to a variety of fixtures (e.g., headboard, light fixture, chair, or tree). In particular, the invention is a support apparatus for suspending reading material having a transparent platform for supporting the reading material, support members arranged to support the platform, and a flexible suspension device that is attachable to a fixture and that permits the user to adjust the inclination of the platform.

The foregoing and other objects and advantages of the invention and the manner in which the same are accomplished will become clearer based on the following detailed description taken in conjunction with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that as used herein the term "platform" refers to a substantially planar surface. The platform may be formed from any number of thermoplastic polymers such as that provided by Rohm & Hass under the name PLEXIGLASS®.

It will be further understood by those skilled in the art that the dimensions, or measurements for an element will be expressed in the order of length (L) and width (W), wherein L is typically the longitudinal dimension and W is usually the lateral dimension.

It will be understood by those of skill in the art that the terms "upper surface" and "lower surface" may also be referred to as "lower surface" and "upper surface", respectively, depending upon the orientation of the platform with respect to the position of an observer. Moreover, it will be understood that an "edge" may be referred to as a "top edge" and "bottom edge", interchangeably, depending upon the orientation of the platform with respect to the position of an observer. Likewise, it will be understood that an "edge" may also be referred to as a "left edge" and "right edge", interchangeably, depending upon the orientation of the platform with respect to the position of an observer.

The term "fixture" refers to an object that is fixed or attached as a permanent appendage or as a structural part (e.g., door, railing, banister). The term fixture may also refer to a less than permanent object such as a piece of furniture (e.g., chair, sofa, or headboard) or a natural object such as a tree.

It will be further appreciated by those of ordinary skill in the art that, as used herein, the concept of an element being "adjacent" another element does not necessarily imply that the elements are contiguous (i.e., in intimate contact). Rather, as used herein, the concept of one element being adjacent another element is meant to describe the relative positions of the elements within the apparatus.

Figure 1:
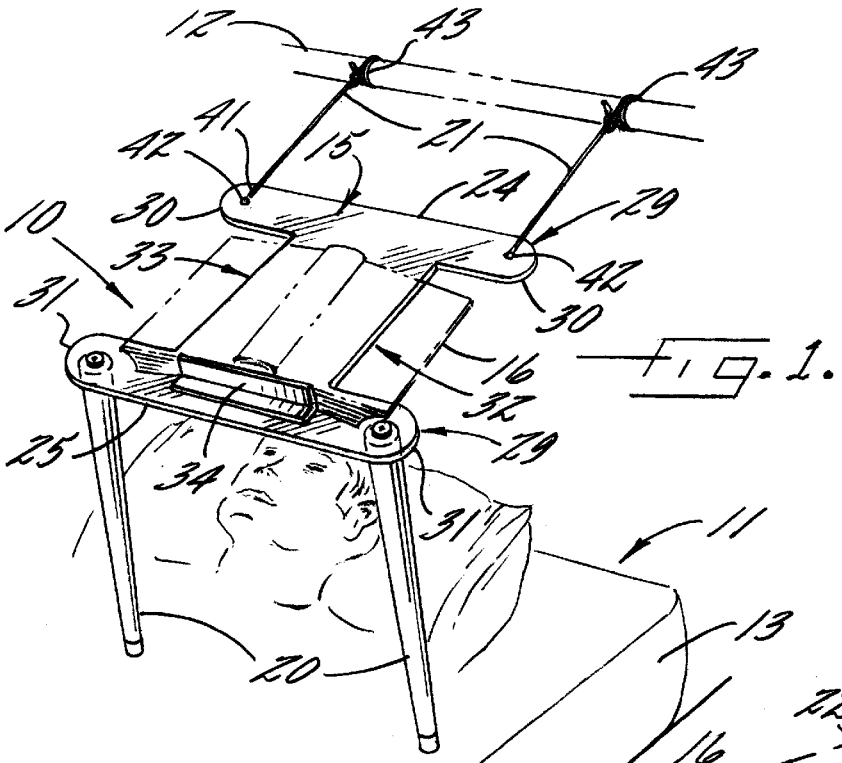
FIG. 1 is a perspective view of a preferred embodiment of the support apparatus depicting an individual using the present invention while lying in bed.
Figure 2:
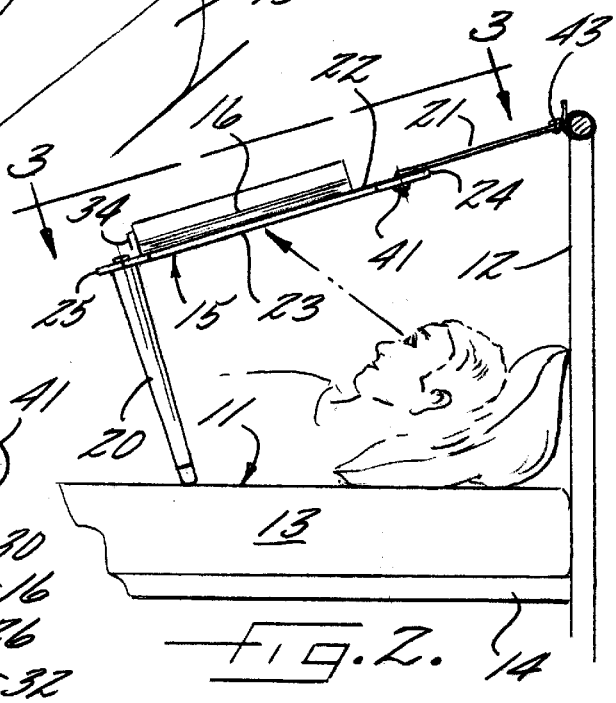
FIG. 2 is a side elevation view of the preferred embodiment of the support apparatus illustrating the transparent platform, support members, and flexible suspension devices.

An overall view of the support apparatus 10 that incorporates features of the present invention is set forth in FIG. 1. As depicted in FIGS. 1 and 2, the support apparatus 10 can be suspended in an adjustable fashion from a fixture such as a bed 11 having a headboard 12, mattress 13, and side rails 14.

A preferred embodiment of the support apparatus 10 shown in FIG. 2 includes a transparent platform 15, a pair of support members 20, and at least one flexible suspension device 21. As discussed herein, the construction of the support apparatus 10 and its component parts permits an individual to releasably secure the flexible suspension devices 21 to a fixture (e.g., bed 11), position the support members 20 on a surface (e.g., mattress 13), situate himself beneath the platform 15 and between the support members, place reading material 16 on the platform, and then read the material from a substantially horizontal or inclined position while maintaining his arms free for movement. If necessary the individual may adjust the angle or inclination of the platform 15 by releasing ends 41 of the flexible suspension devices 21 from the platform, adjusting the length of the flexible suspension devices, and then reattaching the released ends to the platform.

Figure 3:
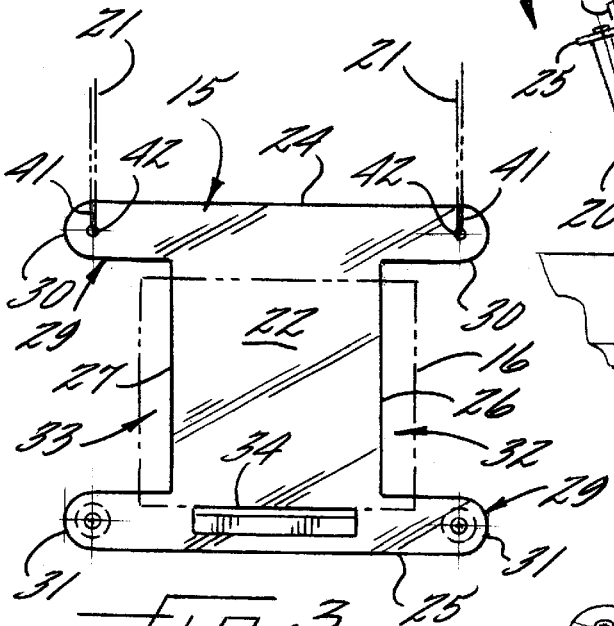
FIG. 3 is a top plan view taken generally along lines 3—3 on FIG. 2 illustrating the arrangement of the opposing cut-outs and shoulders with respect to the platform as well as placement of the elongate member.

The platform 15 includes an upper surface 22, a lower surface 23, a top edge 24, a bottom edge 25, a right edge 26, and a left edge 27. As illustrated in FIG. 3, the platform 15 further includes two pairs of opposing shoulders 29 wherein one pair 30 is formed at the top edge 24 and the other pair 31 is formed at the bottom edge 25. In other words, the top edge 24 includes a pair of opposing shoulders 30 and the bottom edge 25 includes a pair of opposing shoulders 31.

As discussed above, the platform 15 may be formed from any number of thermoplastic polymers that permit an individual to view reading material through the platform. For example, in the preferred embodiment, the platform 15 is formed of thermoplastic polymethyl- or polymethacrylate-type polymers such as that provided by Rohm & Hass under the name PLEXIGLASS®.

In the preferred embodiment depicted in FIG. 3, the platform 15 is substantially I-shaped whereby the platform defines opposing cut-outs 32, 33 at the right edge 26 and left edge 27 of the platform. Stated differently, the two pairs of opposing shoulders 29 define opposing cut-outs 32, 33 that extend substantially perpendicular to the top edge 24 and bottom edge 25 of the transparent platform 15.

Advantageously the cut-outs 32, 33 are arranged to facilitate the placement and repositioning of reading material by the individual. For example, the cut-outs 32, 33 permit the user to reach up with his arms around the platform 15 to access the reading material 16. Specifically, a user can easily place the book on the platform 15 or turn the pages of a book with little effort. Although the preferred embodiment depicted in FIG. 3 depicts substantially rectangular cut-outs 32, 33, the cut-outs may alternatively be C-shaped, V-shaped, or any similar shape that permits a user ready access to the reading material 36.

The platform 15 may also include an elongate member 34 arranged to support the reading material 16 resting on the upper surface 22 of the platform 15. The elongate member 34 is secured to the upper surface 22 of the platform 15. As depicted in the preferred embodiment in FIG. 1, the elongate member 34 is substantially parallel to the top edge 24 and the bottom edge 25 of the platform 15. More specifically the elongate member 34 is positioned adjacent the bottom edge 25 of the platform 15.

The elongate member 34 may be formed from wood, plastic, or other material of sufficient strength to prevent reading material 16 resting on the upper surface 22 of the platform 15 from sliding off of the platform in an inclined position. In a preferred embodiment, the elongate member 34 is a wooden ledge.

Figure 4:
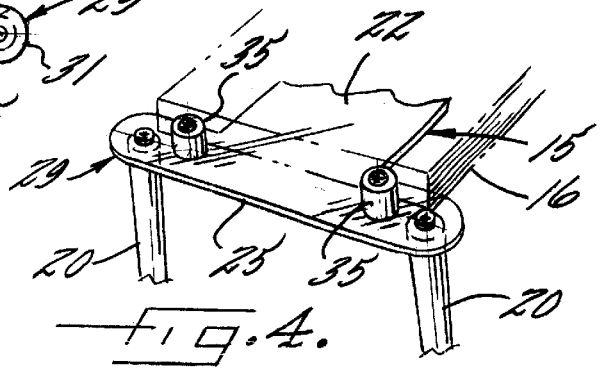
FIG. 4 is an enlarged sectional view of the bottom edge of an alternative embodiment of the platform depicting the support members secured to the lower surface of the platform and projecting members for supporting reading material.
Figure 5:
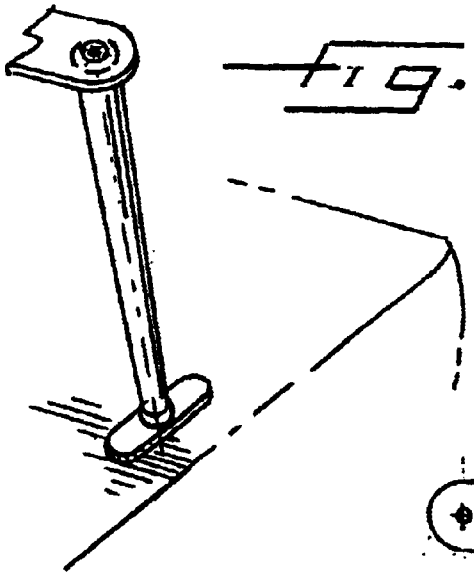
FIG. 5 is an enlarged sectional view of an alternative embodiment of the platform depicting T-shaped support members secured to the lower surface of the platform.
Figure 6A:
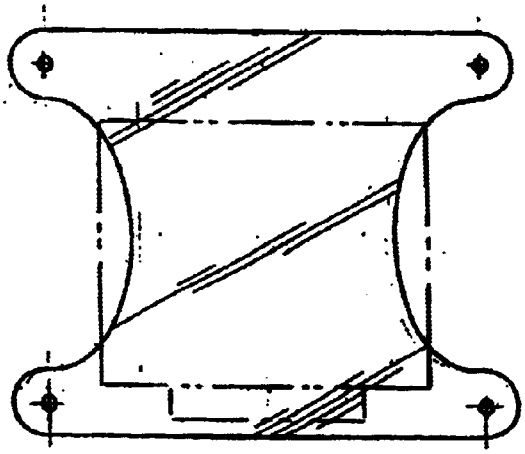
FIG. 6A is a top plan view taken generally along lines 3—3 on FIG. 2 illustrating an alternative embodiment of the platform wherein the cut-outs are C-shaped.
Figure 6B:
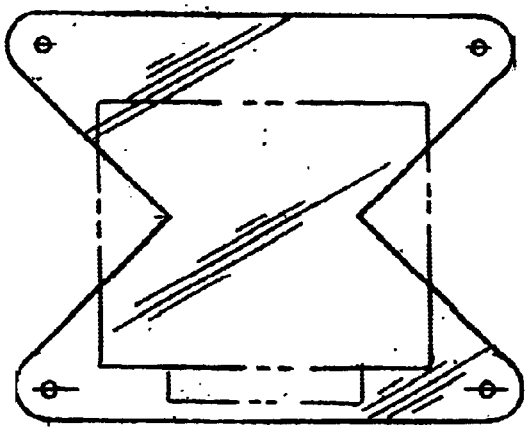
FIG. 6B is a top plan view taken generally along lines 3—3 on FIG. 2 illustrating an alternative embodiment of the platform wherein the cut-outs are V-shaped.

An alternative embodiment of the invention provides at least two projecting members 35 in lieu of the elongate member 34. As illustrated in FIG. 4, the projecting members 35 are arranged to support the reading material 16 and are secured to the upper surface 22 of the platform 15 in a spaced relationship.

The projecting members 35 may be formed from wood, plastic, or other material of sufficient strength to prevent reading material resting on the upper surface 22 of the platform 15 from sliding off of the platform in an inclined position. In one alternative embodiment, the projecting members 35 are wooden cylinders (e.g., spools).

The support members 20 are secured to the lower surface 23 of the transparent platform 15 in a spaced relationship. Each support member 20 is spaced apart from the other to permit the user to position himself between the support members. Accordingly, as depicted in FIG. 2, the support members 20 are arranged to support the bottom edge 25 of the transparent platform 15. Stated differently, each support member 20 is secured to the transparent platform adjacent the bottom edge 25. As illustrated in FIGS. 1 and 3, the support members 20 are affixed to each pair of opposing shoulders 30, 31 at the bottom edge 25 of the platform 15. Thus, one support member 20 is affixed to each opposing shoulder 30, 31 at the bottom edge 25 of the platform 15. The support members 20 may be formed from any variety of materials that provide sufficient strength to support a book resting upon the upper surface 22 of the platform 15. For example, the support member 20 may be formed from wood, plastic, or metal.

In an alternative embodiment, the support members 20 may be extendable such that the platform 15 can be adjusted for height relative to the user in a substantially horizontal position. In other words, the support members 20 telescope for adjustment in length. It will be understood that in the preferred embodiment, the support members 20 may be non-adjustable, yet of a length sufficient to permit the user to position himself underneath the transparent platform 15. As depicted in FIG. 2, each support member 20 is substantially perpendicular to the transparent platform 15. Further, the support members 20 of the preferred embodiment are substantially parallel to one another.

Although the preferred embodiment depicted in FIG. 2 includes support members 20 that are substantially straight, each support member may be substantially L-shaped, C-shaped, or T-shaped.

The flexible suspension devices 21 include at least two ends 41 that are releasably secured to the transparent platform 15. For example, ends 41 of the suspension devices 21 may be placed through openings 42 in the platform 15 and then tied into a knot, thus securing the ends to the platform. Advantageously, the ends 41 are releasably secured to the platform 15 to permit the user to adjust the inclination of the platform relative to the horizontal position of the user. At least two ends 41 are preferably secured adjacent the top edge 24 of the platform 15. As illustrated in FIG. 1, one end 41 of each flexible suspension device 21 is releasably secured to the pair of opposing shoulders 30 at the top edge 24 of the platform 15 while the opposite ends 43 may be secured, for example, to a headboard 12 of a bed 11. The ends 41 of the flexible suspension devices 21 are secured to the top edge 24 of the platform 15 in spaced relationship to promote the suspension and adjustability of the inclination of the platform. The flexible suspension devices 21 may include a rope, a chain, a belt, a cable, a cord, or any number of flexible connectors of sufficient strength to support a book resting upon the upper surface 22 of the platform 15. Accordingly, as depicted in the preferred embodiment of FIG. 2, the flexible suspension devices 21 are arranged to support the top edge 24 of the transparent platform 15.

A as configured, the flexible suspension devices 21 suspend the transparent platform 15 above the individual lying on a surface so that the individual can view reading material 16 that is supported by the upper surface 22 of the transparent platform.

In the drawings and specification, there have been disclosed typical embodiments on the invention and, although specific terms have been employed, they have been used in a generic and descriptive sense only and not for purposes of limitation, the scope of the invention being set forth in the following claims.

What is claimed is:

1. A support apparatus for suspending reading material, said support apparatus comprising:

a substantially rectangular transparent platform having an upper surface, a lower surface, a top edge, a bottom edge, and two pairs of opposing shoulders formed at each of said top edge and said bottom edge;

a pair of spaced apart support members that are secured to said lower surface of said transparent platform, each one of said pair of support members affixed to each one of said pair of opposing shoulders at said bottom edge; and a pair of flexible suspension devices each having two ends, one end of each of said pair being releasably secured to each one of said pair of opposing shoulders at said top edge;

wherein said transparent platform is configured to permit an individual lying in a substantially horizontal position beneath said transparent platform to view reading material that is supported by said upper surface of said transparent platform;

wherein said pair of flexible suspension devices is arranged to adjustably suspend said transparent platform from a fixture.

2. A support apparatus according to claim 1, wherein said transparent platform comprises an elongate member secured to said upper surface of said transparent platform, said elongate member substantially parallel to said top edge and said bottom edge of said transparent platform.

3. A support apparatus according to claim 2, wherein said elongate member is positioned adjacent said bottom edge of said transparent platform.

4. A support apparatus according to claim 1, wherein said transparent platform comprises at least one projecting member secured to said upper surface of said transparent platform.

5. A support apparatus according to claim 4, wherein said at least one projecting member is positioned adjacent said bottom edge of said transparent platform.

6. A support apparatus according to claim 1, wherein said transparent platform is substantially I-shaped.

7. A support apparatus according to claim 1, wherein said two pairs of opposing shoulders define opposing cut-outs that extend substantially perpendicular to said top edge and said bottom edge of said transparent platform, said cut-outs arranged to facilitate the placement and repositioning of the reading material by the individual.

8. A support apparatus according to claim 7, wherein said cut-outs are substantially rectangular.

9. A support apparatus according to claim 7, wherein said cut-outs are substantially C-shaped.

10. A support apparatus according to claim 7, wherein said cut-outs are substantially V-shaped.

11. A support apparatus according to claim 1, wherein said pair of support members is extendable.

12. A support apparatus according to claim 1, wherein said pair of support members is substantially perpendicular to said transparent platform.

13. A support apparatus according to claim 1, wherein each one of said pair of support members is substantially parallel to the other.

14. A support apparatus according to claim 1, wherein said pair of support members is of a length sufficient to permit an individual to position himself underneath said transparent platform.

15. A support apparatus according to claim 1, wherein said pair of support members is substantially L-shaped.

16. A support apparatus according to claim 1, wherein said pair of support members is substantially C-shaped.

17. A support apparatus according to claim 1, wherein said pair of support members is substantially T-shaped.

18. A support apparatus according to claim 1, wherein said ends of said pair of flexible suspension devices are releasably secured to said pair of opposing shoulders at said top edge in spaced relationship.

19. A support apparatus according to claim 1, wherein said pair of flexible suspension devices is selected from the group consisting of a rope, a chain, a belt, a cable, or a cord.

20. A support apparatus for suspending reading material, said support apparatus comprising:

a transparent platform having an upper surface, a lower surface, a top edge, a bottom edge, a right edge, and a left edge;

a pair of spaced apart support members that are secured to said lower surface of said transparent platform, said pair of support members arranged to support said bottom edge of said transparent platform;

at least one flexible suspension device having two ends, one end being releasably secured to said transparent platform, said flexible suspension device arranged to support said top edge of said transparent platform; and opposing C-shaped cut-outs defined by said transparent platform at said right edge and said left edge of said transparent platform, said cut-outs arranged to facilitate the placement and repositioning of reading material by the individual;

wherein said flexible suspension device is arranged to adjustably suspend said transparent platform from a fixture and above an individual lying in a substantially horizontal position beneath said transparent platform to thereby permit the individual to view reading material that is supported by said upper surface of said transparent platform.

21. A support apparatus according to claim 20, wherein said transparent platform comprises:

an elongate member secured to said upper surface of said transparent platform, said elongate member arranged to support the reading material resting on said upper surface of said platform.

22. A support apparatus according to claim 20, wherein said transparent platform comprises:

at least one projecting member secured to said upper surface of said transparent platform, said projecting member arranged to support the reading material testing on said upper surface of said platform.

23. A support apparatus according to claim 20, wherein said pair of support members is substantially L-shaped.

24. A support apparatus according to claim 20, wherein said pair embers is substantially C-shaped.

25. A support apparatus according to claim 20, wherein said pair of support members is substantially T-shaped.

26. A support apparatus for suspending reading material, said support apparatus comprising:

a transparent platform having an upper surface, a lower surface, a top edge, a bottom edge, a right edge, and a left edge;

a pair of spaced apart support members that are secured to said lower surface of said transparent platform, said pair of support members arranged to support said bottom edge of said transparent platform;

at least one flexible suspension device having two ends, one end being releasably secured to said transparent platform, said flexible suspension device arranged to support said top edge of said transparent platform; and opposing V-shaped cut-outs defined by said transparent platform at said right edge and said left edge of said transparent platform, said cut-outs arranged to facilitate the placement and repositioning of reading material by the individual;

wherein said flexible suspension device is arranged to adjustably suspend said transparent platform from a fixture and above an individual lying in a substantially horizontal position beneath said transparent platform to thereby permit the individual to view reading material that is supported by said upper surface of said transparent platform.

27. A support apparatus according to claim 26, wherein said transparent platform comprises:

an elongate member secured to said upper surface of said transparent platform, said elongate member arranged to support the reading material resting on said upper surface of said platform.

28. A support apparatus according to claim 26, wherein said transparent platform comprises:

at least one projecting member secured to said upper surface of said transparent platform, said projecting member arranged to support the reading material resting on said upper surface of said platform.

29. A support apparatus according to claim 26, wherein said pair of support members is substantially L-shaped.

30. A support apparatus according to claim 26, wherein said pair of support members is substantially C-shaped.

31. A support apparatus according to claim 26, wherein said pair of support members is substantially T-shaped.

32. A support apparatus for suspending reading material, said support apparatus comprising:

a transparent platform having an upper surface, a lower surface, a top edge, a bottom edge, a right edge, and a left edge;

a pair of spaced apart support members that are secured to said lower surface of said transparent platform, said pair of support members arranged to support said bottom edge of said transparent platform; and at least one flexible suspension device selected from the group consisting of a rope, a chain, a belt, a cable, or a cord, said flexible suspension device having two ends, one end being releasably secured to said transparent platform, said flexible suspension device arranged to support said top edge of said transparent platform;

wherein said flexible suspension device is arranged to adjustably suspend said transparent platform from a fixture and above an individual lying in a substantially horizontal position beneath said transparent platform to thereby permit the individual to view reading material that is supported by said upper surface of said transparent platform.

33. A support apparatus according to claim 32, wherein said transparent platform comprises:

an elongate member secured to said upper surface of said transparent platform, said elongate member arranged to support the reading material resting on said upper surface of said platform.

34. A support apparatus according to claim 32, wherein said transparent platform comprises:

at least one projecting member secured to said upper surface of said transparent platform, said projecting member arranged to support the reading material resting on said upper surface of said platform.

35. A support apparatus according to claim 32, wherein said transparent platform defines opposing cut-outs at said right edge and said left edge of said transparent platform, said cut-outs arranged to facilitate the placement and repositioning of reading material by the individual.

36. A support apparatus according to claim 35, wherein said cut-outs are substantially rectangular.

* * * * *

UNITED STATES PATENT AND TRADEMARK OFFICE

CERTIFICATE OF CORRECTION

PATENT NO. : 6,637,714 B1
DATED : October 28, 2003
INVENTOR(S) : Leslie Margaret Hall It is certified that error appears in the above-identified patent and that said Letters Patent is hereby corrected as shown below:

Column 8,
Line 5, “testing” should read -- resting --.
Line 10, “pair embers” should read -- pair of support members --.

Signed and Sealed this

Thirteenth Day of January, 2004

JON W. DUDAS
*Acting Director of the United States Patent and Trademark Office*